US008256185B2

(12) United States Patent
Kirkey

(10) Patent No.: US 8,256,185 B2
(45) Date of Patent: Sep. 4, 2012

(54) PRE-ASSEMBLED SHINGLE SET AND INSTALLATION SYSTEM

(76) Inventor: Bryan J. Kirkey, Atlanta, GA (US)

( * ) Notice: Subject to any disclaimer, the term of this patent is extended or adjusted under 35 U.S.C. 154(b) by 598 days.

(21) Appl. No.: 11/937,498

(22) Filed: Nov. 8, 2007

(65) Prior Publication Data

US 2008/0141609 A1 Jun. 19, 2008

Related U.S. Application Data

(60) Provisional application No. 60/865,082, filed on Nov. 9, 2006.

(51) Int. Cl.
*E04B 1/00* (2006.01)
*E04D 1/00* (2006.01)

(52) U.S. Cl. ..... 52/748.1; 52/553; 52/554; 52/518; 52/525; 52/519; 52/557

(58) Field of Classification Search ..... 52/518, 52/525, 105, 553, 554, 555, 519, 557
See application file for complete search history.

(56) References Cited

U.S. PATENT DOCUMENTS 298,682 A * 5/1884 Finch ..... 33/647
1,467,510 A * 9/1923 Smith, Jr. ..... 52/557
2,891,318 A * 6/1959 Harrison et al. ..... 33/648
3,640,044 A * 2/1972 Watts ..... 52/543
3,919,823 A * 11/1975 Bradley ..... 52/557
4,183,144 A * 1/1980 Barnett, III ..... 33/649
4,266,388 A * 5/1981 Flood ..... 52/748.1
4,466,226 A * 8/1984 Rohner ..... 52/748.1
4,468,909 A * 9/1984 Eaton ..... 52/541
4,499,702 A * 2/1985 Turner ..... 52/555
5,018,279 A * 5/1991 Williams ..... 33/649
5,060,431 A * 10/1991 MacLeod et al. ..... 52/199
5,287,669 A * 2/1994 Hannah et al. ..... 52/518
5,570,556 A * 11/1996 Wagner ..... 52/552
5,692,311 A * 12/1997 Paquin ..... 33/647
5,916,103 A * 6/1999 Roberts ..... 52/552
5,924,213 A * 7/1999 Lee ..... 33/494
6,378,223 B1 * 4/2002 Korich et al. ..... 33/649
6,463,708 B1 * 10/2002 Anderson ..... 52/521
6,526,717 B2 * 3/2003 Waggoner et al. ..... 52/554
6,715,240 B2 * 4/2004 Beck et al. ..... 52/105
6,836,969 B1 * 1/2005 Bates ..... 33/42
6,928,743 B1 * 8/2005 Marshall ..... 33/648
6,939,036 B2 * 9/2005 Beck et al. ..... 374/55
7,124,551 B1 * 10/2006 Patera ..... 52/749.1
7,219,476 B2 * 5/2007 Akins et al. ..... 52/551
7,475,516 B2 * 1/2009 Jolitz et al. ..... 52/518
7,631,461 B2 * 12/2009 Shadwell et al. ..... 52/98
7,735,287 B2 * 6/2010 Gaudreau ..... 52/526
7,836,654 B2 * 11/2010 Belt et al. ..... 52/557
2001/0022055 A1 * 9/2001 Zhang ..... 52/309.1
2004/0148895 A1 * 8/2004 Jolitz et al. ..... 52/518
2005/0262790 A1 * 12/2005 Turek ..... 52/518
2008/0034699 A1 * 2/2008 Shadwell et al. ..... 52/553

* cited by examiner

*Primary Examiner* — Mark Wendell
(74) *Attorney, Agent, or Firm* — Smith Risley Tempel Santos LLC; Gregory Scott Smith

(57) ABSTRACT

An assembly, and method for constructing the assembly, to aid in the proper installation of shingles by providing panels of shingles and assembly guides that when followed, result in the installation of shingles that meet keyway width requirements, keyway alignment requirements, provide an aesthetically pleasing distribution of the shingles, and provides adequate ventilation.

10 Claims, 9 Drawing Sheets

A
B
A
B
A
B

PRE-ASSEMBLED SHINGLE SET AND INSTALLATION SYSTEM

CROSS-REFERENCE TO RELATED APPLICATIONS

This application is a non-provisional application filed under 37 CFR 1.53(b) and claiming priority to and the benefit of United States Provisional Application for Patent filed on Nov. 9, 2006 and assigned Ser. No. 60/865,082.

BACKGROUND OF THE INVENTION

The present invention relates to the fields of roofing and/or siding and, more particularly, is directed towards a pre-assembled panel of shingles or shakes as used in construction as a protective covering for roofs and/or sidewalls.

Although shakes and shingles are usually produced from Western Red Cedar or Eastern White Cedar, there are numerous durable rot resistant woods that can be used effectively. Additionally, various natural and synthetic materials can be used to produce shingles that would be appropriate for use with this invention. For simplicity, the terms "shingle" or "cedar shingle" will be used as representative of shingles or shakes of any composition.

While shingles are not defined by the material they are made from, they can be defined as having a unique form and function. Shingles function as a precipitation barrier through the use of large overlaps. In a typical roof installation, only ⅓rd of the shingle is exposed resulting in 3 layers of shingles at any given point in the installation. Any water that leaks through joints between adjacent shingles is redirected to the surface by shingles in the underlying course. This requires that the joints in the underlying course be offset sufficiently from the joints in the upper course to prevent further leaking. In comparison, joints between adjacent sections of lap siding must be sealed to prevent leaks because the overlap from course to course is typically only a fraction of the exposed area. Overlaps are not designed to redirect water to the surface, and a waterproof installation would require all exposed joints to be perfectly sealed. The large size of the siding sections make it difficult to maintain leak-proof seals when the siding expands and contracts with changes in temperature and humidity. The open joints of a shingle installation are designed to accommodate these changes without developing leaks.

Cedar shingles have been used for hundreds of years as a premium roofing and siding material, and have a proven history of durability and superior weatherproofing when properly installed.

While cedar shingles are one of the most waterproof solutions for roofing or siding, they also provide better ventilation than most other materials. The keyways (the vertical gaps between adjacent shingles), relatively course surface texture, and the natural distortions in the material, all provide numerous small airways between shingles. These airways provide ventilation which allows any moisture that has accumulated in the wall or roof to dry to the outside. Even if the shingled surface is entirely waterproof in the most extreme weather, water will be formed when warm moist air that has migrated into the wall or roof structure cools and condenses. Since a vapor barrier is typically installed on the interior side of the wall or roof, it is important that the siding be ventilated well enough to allow this moisture to dry to the outside. If moisture accumulates within the wall structure, and does not have a way to dry out, mold and other fungi that cause rot and decay will thrive.

Essentially, if a typical residential building is otherwise properly maintained and constructed, the lifespan of the structure will be determined by the performance of the roofing and siding. It is significant to note that research following the 2004/2005 hurricane season in Florida has determined that about 90% of the homes that were destroyed had no significant wind related structural damage, but were destroyed by rampant decay in saturated walls. The exterior walls were insufficiently waterproof to shed wind driven rain, and water wicked through housewraps at fastener locations and overlaps. Once saturated, the walls were insufficiently ventilated to allow the walls to dry out.

Understanding the importance of good ventilation, builders have explored the "rain screen" wall concept, which separates the siding from the sheathing to create an airspace which can be ventilated. While it is somewhat difficult to create the airspace, it is very difficult to ventilate it. Typically the ventilation is insufficient, and the airspace created by the rain screen wall becomes another site for condensation, much like the wallspace behind it. Conventional cedar shingles provide better ventilation than stucco, brick, clapboard, panelized, or cementitious siding. However, depending on a variety of conditions, even cedar shingles may not provide sufficient ventilation.

While cedar shingles provide a superior ability to shed precipitation and superior ventilation, they also are considered to be one of the most aesthetically pleasing solutions for roofing and siding. Shingles provide detail for flat surfaces, and the characteristics of the detail can be varied considerably by the size, exposure, type, and finish of the shingles. Cedar shingles are often presented by builders as a premium option over other types of siding and roofing.

Cedar shingles also contribute to the energy efficiency of the structure. Tests have shown that, in hot weather, sheathing under cedar shingles is up to 40° cooler than sheathing under asphalt/fiberglass shingles, which can reduce cooling costs significantly. During cold weather, cedar shingles, because of their low density, provide better insulation than other types of roofing and siding materials. More importantly, well ventilated dry insulation performs much better that wet insulation.

Although there are many advantages to cedar shingles, there are significant problems related to the installation of this product.

One of the most significant problems involves the size and position of the joints between adjacent shingles. Guidelines and building codes for the installation of cedar shingles require a space or keyway between adjacent shingles to allow for expansion of the shingles when they become wet. The keyways must be accurately and consistently sized for both function and appearance. Keyways that are too narrow will not allow shingles to expand enough when they become saturated, which will cause the shingles to buckle.

Additionally, according to generally accepted guidelines and building codes, keyways must be horizontally offset from keyways in the next 2 and previous 2 courses for roofing, and in the next and previous course for siding. The required minimum offset distance is 1½". Shorter offset distances will result in leaks when wind driven precipitation is blown sideways between shingles to nearby keyway locations. Adhering to this requirement, however, makes the process of installing shingles very time consuming and tedious.

A good professional installation requires planning for keyway spacing, as well as planning for an aesthetically balanced distribution of random width shingles. It's important to avoid patterns that will stand out, such as a cluster of small or large shingles or a diagonal pattern of same-size shingles. A good installer spends a significant amount of time choosing the right shingle from a supply of random width shingles, as well as cutting shingles to the required width. The more diligent the installation, the more time consuming the installation process becomes. Often, installers simply fail to adhere to the codes because the process is too time consuming. Shingle manufacturers indicate that nearly all warranty claims are the direct result of improper installation.

Another problem associated with cedar shingles is that the natural tannins in the wood can, according to some studies, degrade the water repellency of some vapor permeable housewraps. The smooth surface of newer housewraps also has a tendency to "wick" water through fastener holes and overlaps, when any type of siding lays flat against the housewrap. This capillary action can result in very significant amounts of water being drawn into the wall. Another problem related to this is the tendency for shingles to warp or "cup" when moisture remains trapped between the shingles and the housewrap after the front of the shingles dries out.

There have been several attempts to develop products that address some of the problems outlined above. Products such as CEDAR BREATHER, a nylon 6 matrix, and textured or dimpled housewraps have been developed to create an airspace between the shingles and the housewrap or sheathing. These may provide some benefit because they provide a capillary break between the shingles and the housewrap where water could otherwise become trapped and wick through the housewrap. However, as discussed previously with respect to rainscreen walls, ventilating this newly created airspace is very difficult. It requires continuous vents at the upper and lower edges of the roof or wall, as well as above and below all windows, chimneys, dormers, etc. Even with all vents in place it is still not possible to provide adequate ventilation to prevent condensation cycles from occurring to some degree in this air space.

It is interesting to note that the company that marketed the nylon 6 matrix as CEDAR BREATHER has introduced a newer product that includes drainage channels. The benefit of the capillary break is offset by condensation that forms in the airspace used to create the capillary break. For walls with vapor permeable housewraps, as temperature and pressure build up in this airspace, the moisture from condensation vaporizes and passes through the housewrap into the wall structure.

Products have also been developed to make the installation of cedar shingles less tedious and time consuming. A number of shingle panels have been patented and/or marketed as a means to install a group of shingles at one time. These concepts generally fall into three categories.

The first category includes panels comprised of shingle segments attached to a sheet of plywood or similar material, with the sheet fully or nearly fully containing the shingle segments. This type of panel provides a cedar shingle "look", but the panelized shingle segments do not function as shingles. These products are essentially panelized or lap siding embellished with cedar shingle segments. As such, they can claim the durability and beauty of cedar, but they do not have the superior weatherproofing capacity of shingles.

Additionally, when shingles are installed conventionally, a waterproof layer of housewrap and flashing protects the sheathing from any exterior moisture that gets past the shingles. With shingle panels, the shingle segments are already attached to a layer of sheathing, and both elements are installed as one unit, leaving no opportunity to provide a waterproof layer between them. Although some panels are manufactured with a housewrap between the shingles and the base layer, there is still no opportunity to protect the edges of the base layer, especially when the panel is cut at door and window openings. Another disadvantage of this type of panel is that, because the panel is not a structural element (because there are limitations in how it can be fastened), it must be installed over standard sheathing. This is not only wasteful but causes the siding surface to project further outward than normal creating problems with the fit of window and door trim. In addition, the code required vapor permeable housewrap that has already been applied to the sheathing is now sandwiched between two layers of sheathing, greatly diminishing its ability to vent water vapor, and increasing the potential for trapped moisture and condensation inside the wall. In addition, panels of this type must be cut with a saw, rather than a knife, as with conventional shingles. Since this must be done on the ground, rather than on the scaffolding, it offsets some of the time savings gained by installing larger units.

Still another disadvantage of this type of panel is that it depends on a special overlapping joint to connect the panels left to right in a course. Because panels cannot be joined without this special joint, panel sections that are cut off at the end of each course, and at doors, windows, etc. cannot be rejoined with other sections. Depending on the size of the wall and the frequency of surface interruptions, this can result in a very high percentage of waste. The alignment of keyways with this type of panel is irrelevant because these panels do not function as shingles. The top and bottom edges of the panels overlap slightly to enable drainage from one panel course to the next, but all joints must be sealed to prevent leaks. Clearly, the horizontal and vertical joints between panels have a much greater potential to leak than conventionally installed shingles. For this reason, these panels can only be used for sidewalls, and not for roofs.

The second category of existing shingle panels includes shingles that may be up to full size, and are joined together by rigid backerboard that attaches only to the upper portion of the shingles, allowing the lower portion of the shingles to overlap the previous course. These panels function to some degree as shingles, but cannot provide triple layer coverage. These panels are also not sufficiently waterproof to allow them to be used as roofing. Because the backerboard functions as a second layer of sheathing, these products share many of the same problems outlined above for panels with full backerboards.

The third type of panel uses a board that joins shingles together by attaching to the front side of the shingles. In one instance, the board is attached to the exposed part of the shingles and is removed after the upper portion is attached to the wall. This leaves fastener holes in the exposed part of the shingles. There is also the possibility that the shingles will split when the board is being removed. In addition, if the panels are left in sunlight prior to installation, the part of the shingle that is not covered by the board will darken significantly, resulting in an uneven appearance when installation is complete.

Other panels of this type use a thin narrow board that joins the shingles at the top of the front side with a board that is thin enough that it can stay in place during installation. However, the board is thick enough that it eliminates the bowed shape that shingles normally assume when they span between the previous course and the sheathing. This bowed shape provides a spring like tension that helps shingles stay flush against the previous course. With this type of panel, shingles don't lay flat and flush on the previous course. Because of the connecting board, a space is created between the layers of shingles. This space allows wind blown precipitation to move sideways between layers where it can access underlying keyways and pass through to the sheathing. Again, as with the other panels, this type of panel is less waterproof than conventionally installed shingles and cannot be used for roofs.

In addition, because this panel is joined only with a thin board attached to the thin end of the shingles, the panel is relatively fragile. Shingles can be easily damaged or knocked out of alignment. Because of its lack of strength, the panel is necessarily limited to a relatively short width, which is too short to provide sufficient keyway offsets over multiple courses and eliminate diagonal patterning. Following the instructions for the installation of this product actually results in keyway placement that does not meet building code requirements.

In fact, none of the panels that I am aware of, and that function to some extent as shingles, adequately addresses the issue of keyway spacing. Typically, single course panels are installed with each successive course offset a fractional width of the first shingle in the panel. This results in a strong diagonal pattern of every element in the panel. Another problem common to all of these panels is that the addition of a backer board makes it more difficult to pack and ship the panels, adding significant weight and volume, increasing shipping costs as well as increasing the effort required to move and install the product at the job site.

Thus, there is a need in the art for a pre-assembled set of shingles (the "shingle set"), together with an installation system. More particularly, there is a need in the art for a shingle set that meets one or more of the following criteria:

will enable a much more rapid installation of shingles as compared to the conventional method of installing shingles one at a time;

will not compromise the function and performance of the individual shingles in the set as compared to individual shingles properly installed in a conventional manner;

will include markings or guidelines to indicate the proper placement of each subsequent shingle set during installation, as necessary to maintain a pattern of proper keyway offsets;

will be such that persons with little or no particular knowledge, relevant experience, or skill, can feasibly install the product and achieve results of the highest possible quality;

will result in keyway offsets of at least 1½" over the next 2 and previous 2 courses without requiring the normal planning or decisions of the typical shingle installer;

will result in a balanced distribution of various shingle widths and no apparent repetitive patterns, without requiring the normal level of planning or decisions of the typical shingle installer;

will be interconnected in a manner that does not add significant thickness to the shingles and will not affect the position of the shingles or how the shingles lay with respect to each other and the underlying sheathing, as compared to conventional installation, thus maintaining function and performance in line with conventionally installed shingles;

will be interconnected in a manner that allows the set to be cut with a knife rather than a saw;

will be interconnected in a manner that does not add significant thickness, allowing the shingles to be stacked flat and shipped without the use of spacers and without significant additional weight and volume;

will be such that keyways are of a precise and consistent width;

will be manufactured such that the method of securing shingles in position in the set will provide measures to prevent shingles to be knocked out of alignment or easily damaged during shipping and handling (i.e., the shingle set will be durable enough that it can be handled in a manner typical of construction finishing products without damage);

will be such that the method of securing the shingles allows the shingles to expand and contract in a conventional manner;

will be such that the natural ventilating ability of shingles is further enhanced by including a number of ridges applied to the back of the shingles and running vertically.

Thus, there is a need in the art for an improved shingle apparatus and system.

BRIEF SUMMARY OF THE INVENTION

The various features, aspects and embodiments of the present invention cooperatively provide a pre-assembled set of shingles, integrated with a unique installation system, that provides the proven performance of full size cedar shingles, with the added benefits of integral ventilation, and a fast and easy installation process that provides substantially uniform and equal keyway spacing, and proper keyway offsets, automatically. Advantageously, embodiments of the present invention alleviate the moisture related damage that can result from improper shingle installation, or the use of inferior products.

In an exemplary embodiment of the present invention, the shingles are connected to each other, not to a backer board. When installed, they function as full size shingles, not as panels with a shingle "look". The installation system provides full triple layer coverage and the same superior weatherproofing as conventional full size shingles, properly installed. Other siding products, such as shingle panels and clapboards, do not have sufficient overlaps to prevent leaks. This is why they are not adequate in roofing applications. However, in extreme weather, wall coverings must perform as well as roof coverings to prevent damage from wind driven precipitation. Essentially, wind can replace gravity as a force that drives moisture inward through the layer(s) of protective covering.

Cedar shingles provide a highly weatherproof barrier when properly installed. Proper installation means that the keyways (the joints between adjacent shingles) must be offset from the keyways in the next two courses above and below the current course. The minimum offset imposed by typical building codes for adjacent courses is 1½ inches. Meeting this requirement, when installing shingles conventionally, is very tedious and time consuming. Consequently, this code requirement is often ignored or compromised, resulting in leaks.

Another advantage of the various embodiments of the present invention is that they operate to reduce the work involved in the shingle installation process. The system is carefully calculated to provide optimal keyway offsets, and a well balanced appearance, automatically. Installation is a simple process of matching the numbers on the pre-assembled shingle strips from course to course. Keyways will be offset by at least the minimum required distance, and there will be little or no apparent patterns, and no clusters of narrow or wide shingles.

The shingles in the various embodiments of the present invention are attached to each other, not to a backer board. This allows for full triple layer overlaps for superior weatherproofing. Unlike pre-assembled shingle panels, there are no special panel joints that can be a source of leaks, and that result in wasted cut-off sections. Also unlike shingle panels, the various embodiments of the present invention allow the proper use of flashing between the shingle layers to re-direct water to the exterior. Because there is no backer board, the shingle strips in embodiments of the present invention can be cut with a knife, and details such as corners, hips and ridges are handled just as with conventional shingles. There are no additional proprietary components that need to be ordered and installed to create these details.

In addition to superior weatherproofing and much faster installation, the pre-assembled shingle strips also provide enhanced ventilation. Ventilation ridges on the back of the shingles provide a slight space between shingles, and between shingles and the housewrap. These ridges will create numerous airways that run from the backside of the shingles, between shingle layers to the exterior, as distinct from an airspace contained behind layers of shingles. These airways will enable airflow which promotes drying. The ridges will also create a capillary break between shingle layers and between shingles and the housewrap, preventing exterior moisture from soaking inward toward the building sheathing. The small size, consistent height, and vertical orientation of the ridges will prevent windblown precipitation from moving laterally between shingle layers and passing through hidden offset keyway openings. This built-in ventilation prevents moisture related mold and decay fungi in several ways as follows:

Allows water vapor from inside the structure to dry more readily to the exterior.

Provides a capillary break between shingles, and between shingles and the housewrap, preventing trapped moisture, which can be drawn into the wall by capillary action.

Allows saturated shingles to dry on both sides, which reduces shingle cupping.

Prevents contact between the housewrap and extractives in cedar shingles, which degrades the water repellency of some housewraps.

Prevents windblown precipitation from moving sideways between shingles to underlying keyway locations.

Eliminates the need for other problematic ventilation systems.

Another advantage of the various embodiments of the present invention is that they provide ventilation to the exterior throughout the entire surface. Other systems, which use lath or mesh between the shingles and the sheathing, create an airspace, not ventilation. If this airspace is not properly ventilated it will create an additional source of moisture as warm humid air cools and condenses, or is pressurized and diffuses through the vapor permeable housewrap. It is very difficult, if not impossible, to adequately ventilate an airspace system. Continuous screened vents are required at the top and bottom edges of the installation, and above and below all windows, chimneys, dormers, etc. Adding these vents can make exterior trim work awkward and unattractive. In addition, the additional thickness of the airspace requires the use of jamb and sill extensions on windows and doors.

Independent of the installation system that manages the keyway positions, another aspect of the invention is that a set of shingles is provided without them being mounted to a board, which maintains the true functional superiority of a shingle. With the spacers in compression, and the front and back bonding strips in tension, the assembly is strong and has limited flex, and because of the upper and lower strips, the butt edges are always perfectly aligned (it will not curve at all in that direction).

These and other features, aspects, advantages and embodiments of the present invention are better understood by reviewing that attached figures and the accompanying description.

DETAILED DESCRIPTION OF THE INVENTION

The present invention, as well as features and aspects thereof, is directed towards providing an assembly to aid in the proper installation of shingles and includes a method for installation of the shingles. In general, embodiments of the invention provide panels of shingles and assembly guides that when followed, result in the installation of shingles that meet keyway width requirements, keyway alignment requirements, provide an aesthetically pleasing distribution of the shingles, provides adequate ventilation, and other benefits. Turning now to the figures in which like labels refer to like elements through the several views, various features, aspects and embodiments of the present invention are described.

Figure 1A:
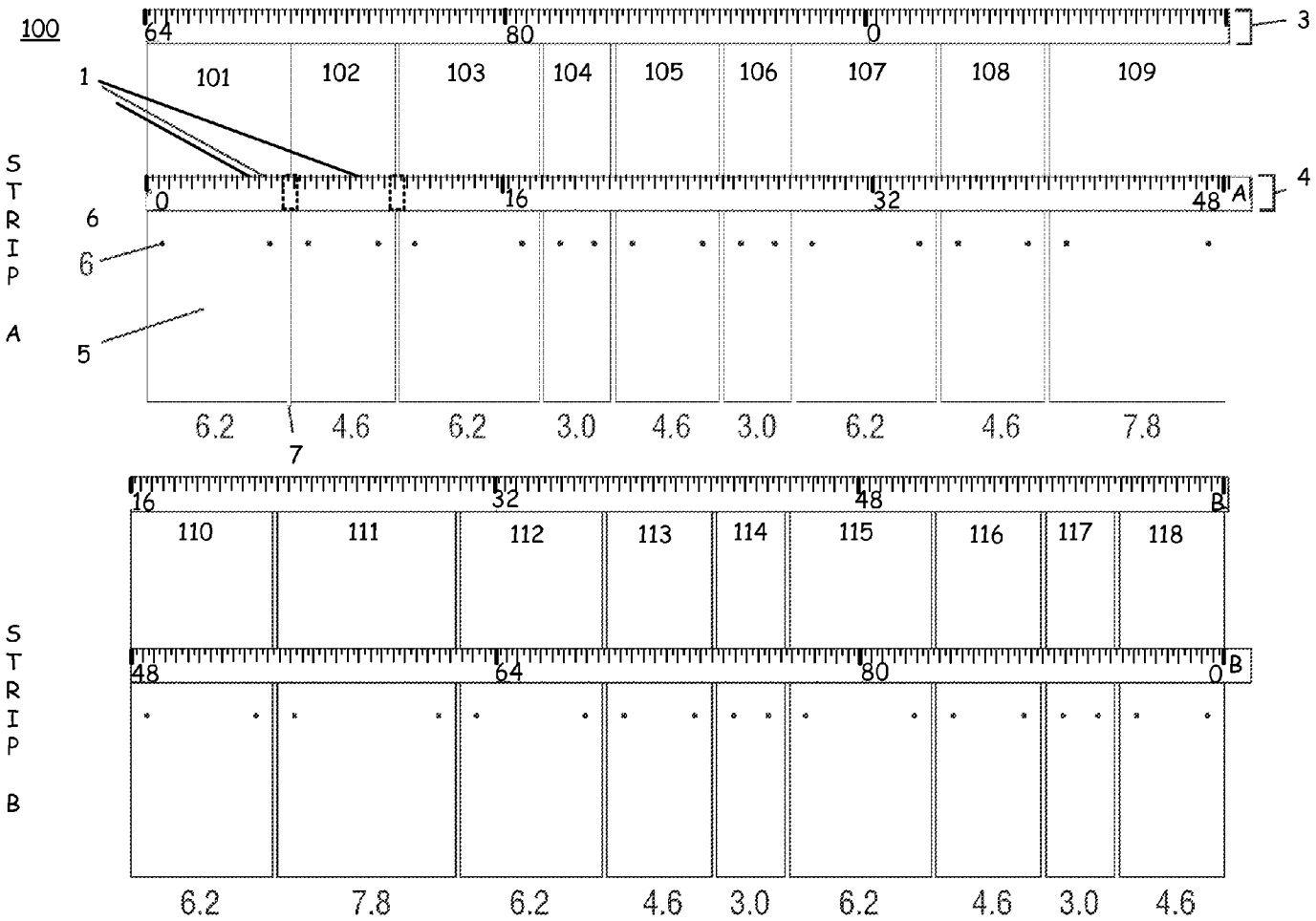
FIG. 1A is a conceptual diagram illustrating the front-side of two shingle strips, sheet A and sheet B, which, when installed adjacent to each other as a course segment, form one complete shingle set.

FIG. 1A is a conceptual diagram illustrating the front-side of two shingle strips, sheet A and sheet B, which, when installed adjacent to each other as a course segment, form one complete shingle set. The shingle strips include shingle spacers 1, upper and lower bonding strips 2 on the back of the shingles, printed upper front bonding strip/ruler 3 (or alignment gauge), printed lower front bonding strip/ruler 4 (or alignment gauge), shingles 5, nails 6 and keyway spacing 7 between the shingles 5. The shingle set 100 is illustrated as being broken into two strips, strip A and strip B, however, it will be appreciated that the shingle set could be a single strip or broken into more than two strips. The two strip embodiment for a shingle set 100 advantageously allows the set to be shipped in 2 sections on standard size pallets. The limited length also facilitates handling and installation of the strips by one person. A set longer than one strip is preferable to provide a random appearance without patterning while still maintaining proper keyway offsets. The shingle spacers (1) establish precise keyway sizing 7 during manufacture, and keep shingles (5) in alignment during shipping and installation. These spacers (1) prevent the shingle assembly from compressing laterally, allowing a semi-rigid assembly to be fabricated by interconnecting the shingles (5) with thin non-elastic bonding strips (2,3,4) that are attached to the front and back surfaces of the shingles using adhesive or some other means.

Alternatively, the shingles (5) could be connected without bonding strips on the back (2), and possibly without shingle spacers (1), if the front bonding strips/rulers (3,4) are sufficiently rigid.

The rulers (3, 4) can be printed directly on the bonding strips on the front side of the shingles, on the shingles themselves or they can be separately printed strips that adhere to the surface of the front bonding strips. It will also be appreciated that the rulers may be printed onto a single strip rather than one strip per ruler. Furthermore, it will be appreciated that a single alignment gauge or ruler may be used and the installer is simply instructed to adjust the alignment gauge in accordance with a set of rules. For instance, in one embodiment of the invention, the lower ruler 4 of FIG. 1 may be the only ruler on the strips and the installer is instructed to shift each successive course ⅓ of the width of the panel, or 32 inches to the right relative to the previous course. Or stated otherwise, for the ruler 4, the installer may apply the rule that the number of a successive course that is to be aligned with the previous course is expressed by the equation:

number of successive course=(number of previous course−32)

The rulers can include a variety of indicia, and one such non-limiting example is to use numbers. However, those skilled in the art will appreciate that any combination of numbers, alphabetical characters, alpha-numeric characters or any other symbols or graphics could likewise be used. In an exemplary embodiment, the numbers on the lower ruler (4) are the main numbers. The numbers on the upper ruler (3) are the guide numbers. Each new course is positioned so the main numbers of the new course match (align vertically with) the guide numbers of the previous course. The highlight numbers indicate starting points for the strips. Intermediate numbers allow the installer to resume the required pattern of installation when working across cut outs such as windows, and to reuse cut off strip segments in the correct position. The keyway positions are carefully calculated to result in proper keyway offsets as successive courses are installed using the integrated number matching system.

In the particular embodiment illustrated in FIG. 1A, the pattern of shingle widths are such that, when the next two courses are installed above a particular course, a vertical line drawn through any keyway in any course will be offset at least 1½" horizontally from any keyway in the other 2 courses (either above or below the particular course).

The width of the panels in this embodiment is 96 inches. The joint spacing is established by dividing the width of the panel (96 inches) into 1.6 inch spaces. The shingle widths are sizes that fill either 2, 3, 4 or 5 of these 1.6 inch spacings. As such, the shingle widths, including the keyways or spaces which in the illustrated embodiment is 0.2 inches, are multiples of 1.6 inches, or 3.2 inches, 4.8 inches, 6.4 inches, and 8.0 inches.

In establishing the pattern illustrated in FIG. 1, or an alternative pattern, the following process could be used. First, 3 offset positions can be established on a background grid of 1.6 inches, such as in the illustrated embodiment of 32 inches, 64 inches and 96 or 0 inches (note that 32, 64 and 96 are divisible by 1.6, so the offset positions align with the grid). Next, a pattern of shingles is established, which in the illustrated embodiment includes shingles 101 through 118. This pattern is repeated in two additional strips that are laid on the grid at the 32 inch offset and 64 inch offset respectively. The pattern of shingle widths in the three courses are arranged (with the same adjustments being made to each pattern in each course) until none of the joints aligned. This technique provides at least the minimum joint offset required by ICC code of 1.5 inches in the next course, and "not aligned" in the one after that. Using this technique, the term "not aligned" can be treated as 1.6" offset. Thus, an offset of at least 1.5 inches over the next 2 courses is established.

Figure 1B:
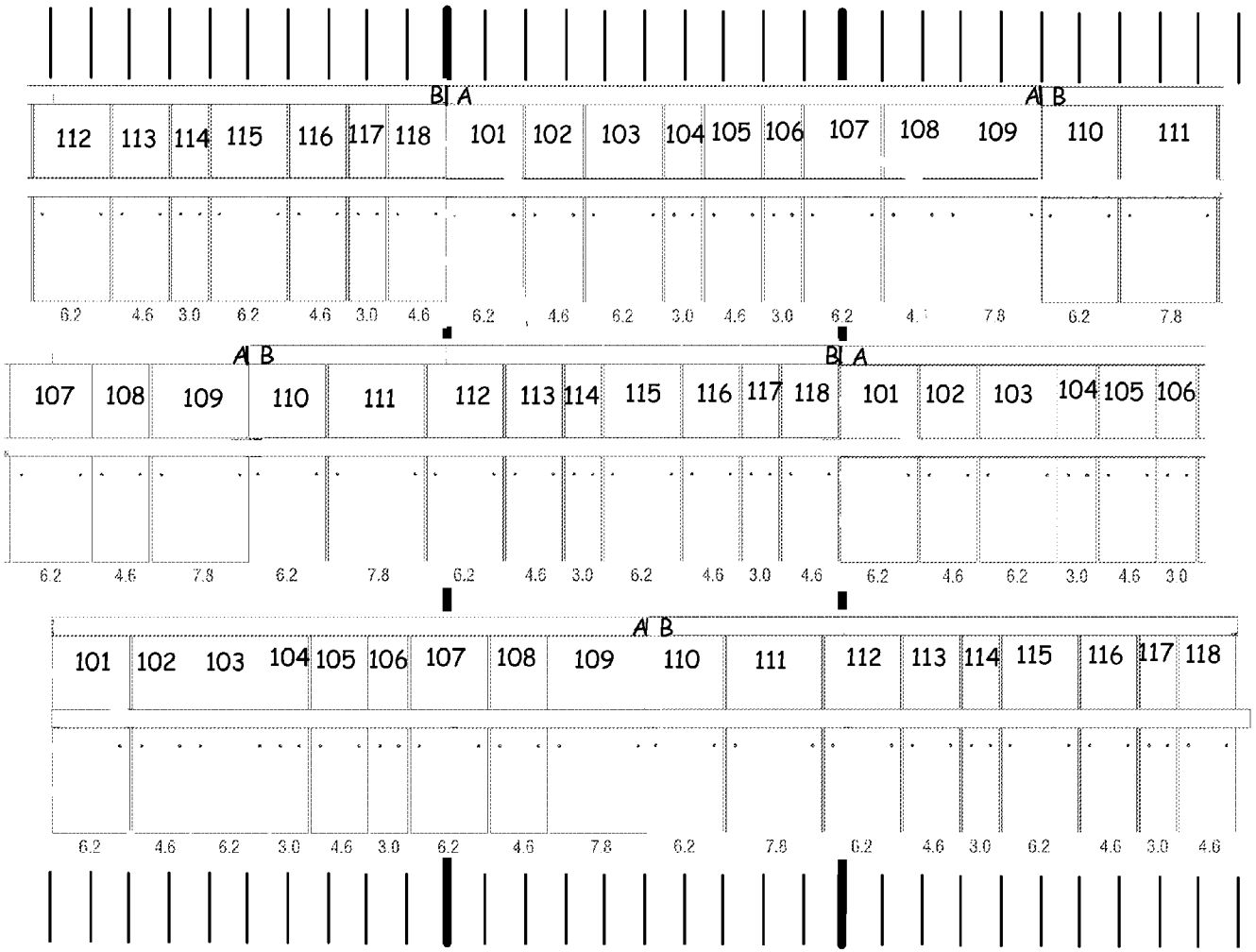
FIG. 1B is a conceptual diagram illustrating the layout of three courses of shingles on the 1.6 inch grid with the 32 inch and 64 inch offsets being highlighted by the thick bolded lines.

FIG. 1B is a conceptual diagram illustrating the layout of three courses of shingles on the 1.6 inch grid with the 32 inch and 64 inch offsets being highlighted by the thick bolded lines. The relationship of the shingles 101 to 118 are clearly illustrated in the three courses and from observation, it is easy to determine that no two keyholes are in alignment. It will be appreciated that this same technique could be applied to generate a wide variety of panel styles and shingle combinations and the illustrated embodiment is provided as a non-limiting example, although in and of itself the illustrated embodiment may be considered to be novel.

Other shingle widths and grid spacings could be used.

Figure 2:
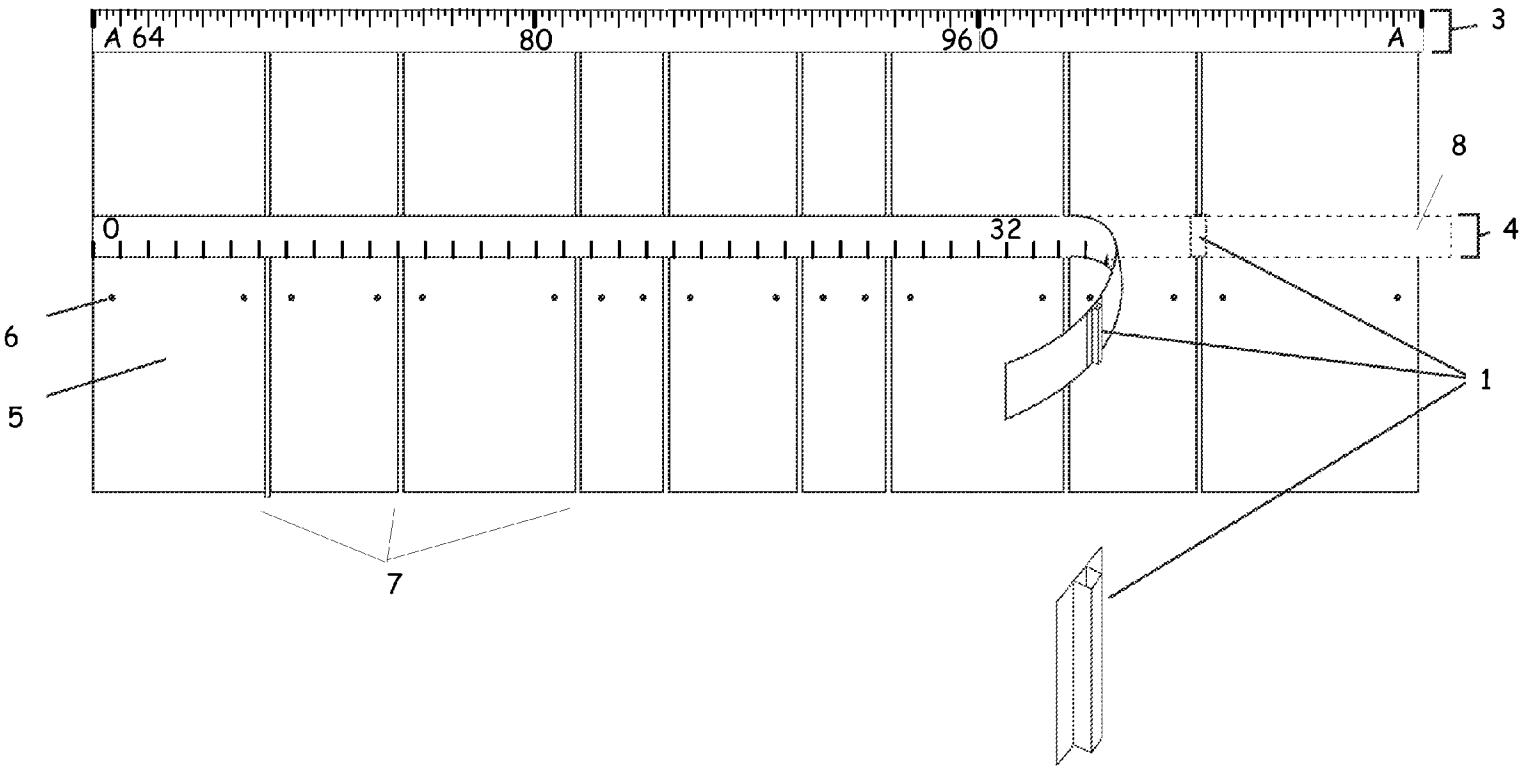
FIG. 2 shows the lower front bonding strip/ruler (4) being removed along with the shingle spacers (1).

FIG. 2 shows the lower front bonding strip/ruler (4) being removed along with the shingle spacers (1). At the time of installation, this strip is removed to prevent it from showing through the keyways of the next course. The spacers are removed to allow the shingles (5) to expand without buckling, and to allow ventilation through the keyways. The protruding tab (8) on the lower front bonding strip/ruler (4) facilitates removal.

When the shingle strip is assembled, the shingle spacers (1) are installed between the shingles. The lower front bonding strip/ruler (4) is then applied, and adheres to both the spacers (1) and the shingles (5). When the lower front bonding strip/ruler is removed, the shingle spacers (1) are removed along with it. The upper front bonding strip/ruler (3) can be mounted permanently to the shingles (5) or can simply not be removed by the installer when installing. As previously mentioned, rather than spacers, the bonding strip(s) can be used to hold the shingles in position and at particular spacings. Similarly, the spacers could be integral to the bonding strip(s) such as attached protrusions or formed into the bonding strip(s).

The lower front bonding strip/ruler (4) can be positioned in the non-visible area of the shingles to alleviate aesthetic issues caused by the adhesive raising the grain on the shingles when removed and leaving an adhesive residue that interferes with finishing. An appropriate non-permanent adhesive is preferably selected for this bonding strip to insure there is sufficient strength to avoid breaking the strip during shipping and installation, but not so much strength that removing the strip damages the shingles. The other bonding strips may have a more permanent adhesive.

In one embodiment of the present invention, the front side bonding strips/rulers (4) are thin PVC strips pre-printed with the ruler graphic, and bonded to the shingles with a high temperature resistant, pressure sensitive, hot melt adhesive. In line ink jet printing could also be used to print directly to a bonding strip after it is applied. For the more permanent bonding strips on the back of the shingle strip, thin fiberglass cloth or scrim bedded in a hot melt adhesive may be utilized. Numerous other materials and bonding strategies could be used depending on the nature of the equipment available.

Figure 3:
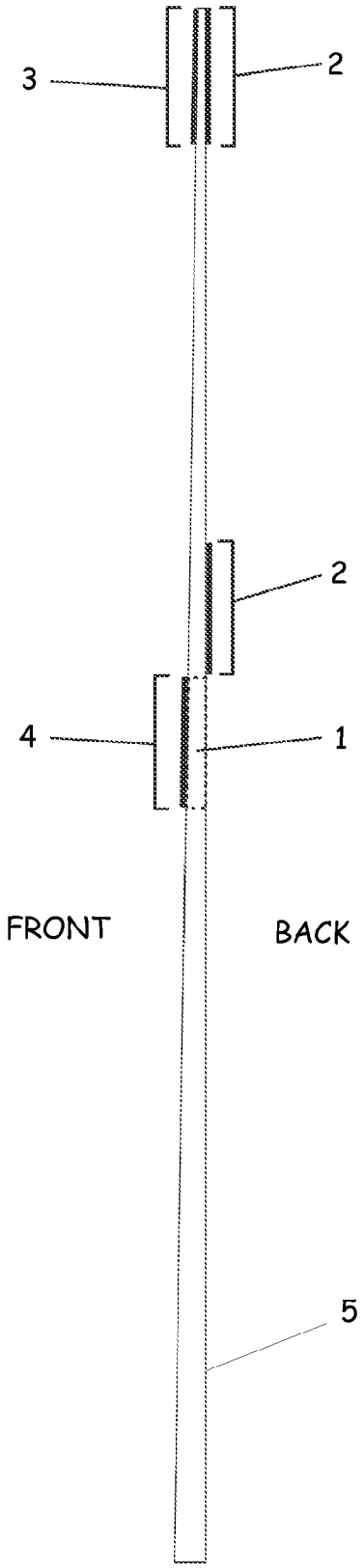
FIG. 3 is a side view of the shingle strip that shows the position of the back bonding strips (2), the shingle spacers (1), the upper front bonding strip/ruler (3), and the lower front bonding strip/ruler (4) positioned on a shingle (5).

FIG. 3 is a side view of the shingle strip that shows the position of the back bonding strips (2), the shingle spacers (1), the upper front bonding strip/ruler (3), and the lower front bonding strip/ruler (4) positioned on a shingle (5).

Figure 4:
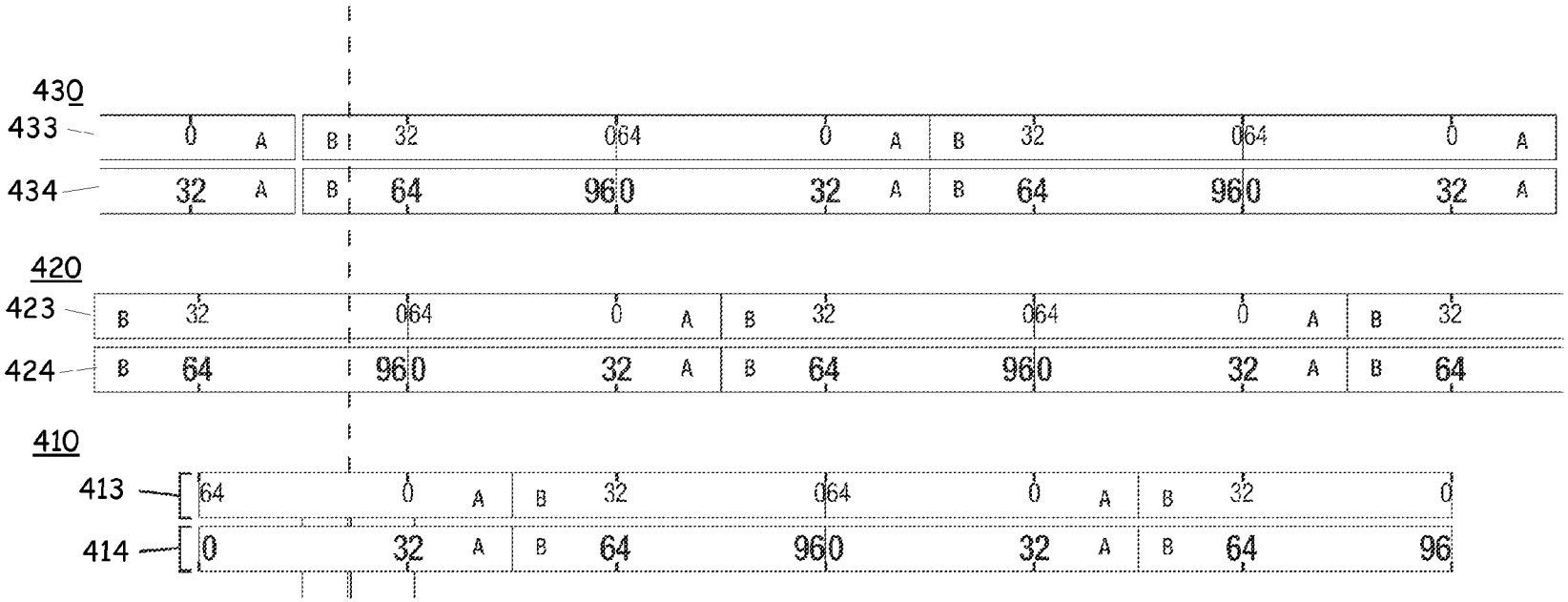
FIG. 4 is a detailed diagram illustrating how the rulers can be aligned to offset the shingle strips over 3 successive courses.

FIG. 4 is a detailed diagram illustrating how the rulers can be aligned to offset the shingle strips over 3 successive courses. When laying the strips into position, the main numbers that appear on the lower ruler and the guide numbers in the upper ruler are aligned with each other. The numbers in the rulers are designed to ensure that the keyways are aligned in accordance with code, thereby ensuring that the keyways in the two adjacent courses above an below a current course are not in alignment with each other and include a minimum offset. More specifically, FIG. 4 illustrates three courses of shingles—course 410, 420 and 430. The first course 410 is laid across the surface to be covered by alternating between strip A and B. The strips of the first course includes an upper ruler 413 and a lower ruler 414. The second course 420 is laid on top of, or overlapping with, the first course. The strips of the second course include an upper ruler 423 and a lower ruler 424. The numbers in the lower ruler 424 of the second course 420 are shown as being in alignment with matching number in the upper ruler 413 of the second course 410. Thus, the 64 of the first strip B of course 420 aligns with the 64 of ruler 413 in the first strip A of course 410.

The third course 430 likewise includes an upper ruler 433 and a lower ruler 434. The 32 in the lower ruler 434 of course 430 is shown as being in alignment with the 32 of the upper ruler 423 of course 420.

Figure 5:
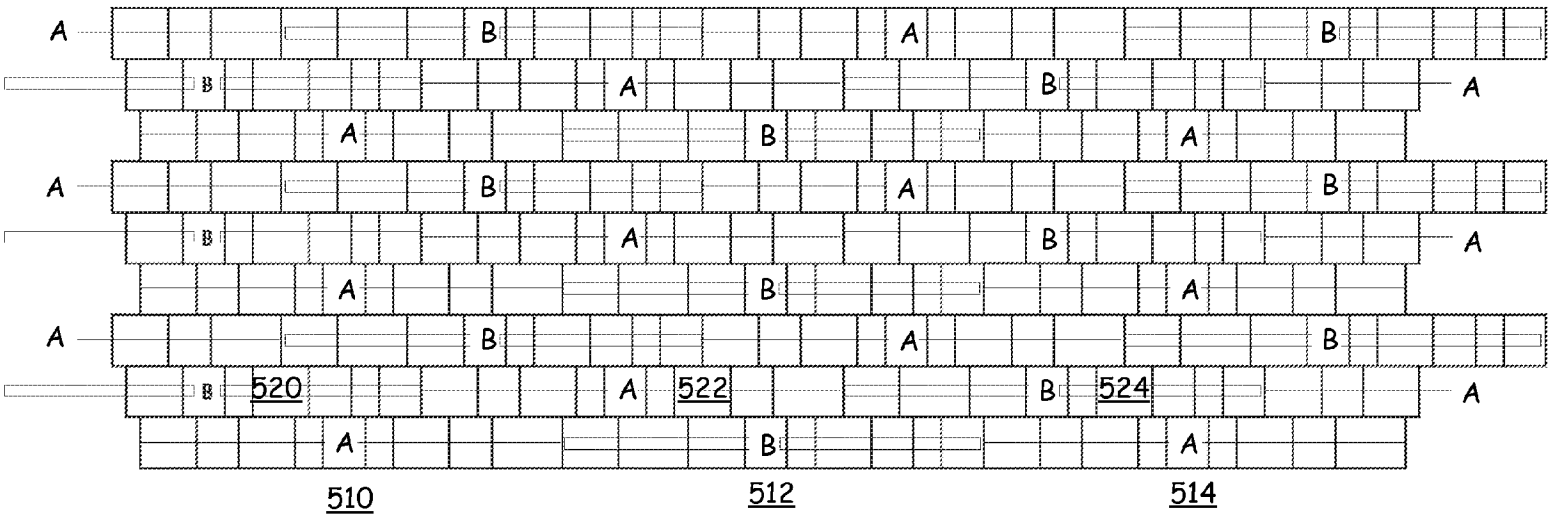
FIG. 5 is a layout diagram illustrating a section of installed shingle strips (A and B) using the integrated number matching system.

FIG. 5 is a layout diagram illustrating a section of installed shingle strips (A and B) using the integrated number matching system. In the preferred configuration, the entire width of the pattern of shingle widths, strips A and B combined, is offset by ⅓rd the pattern width in each successive course. Offsetting successive courses by ⅔rds and ⅓rd the distance of the shingle set, rather than ½ the distance, as is typical with a running bond pattern, creates a more complicated pattern which repeats less frequently, and which, combined with a variety of shingle widths, and the generous length of the shingle set pattern (96" as shown in FIG. 1), is difficult to detect.

Figure 6:
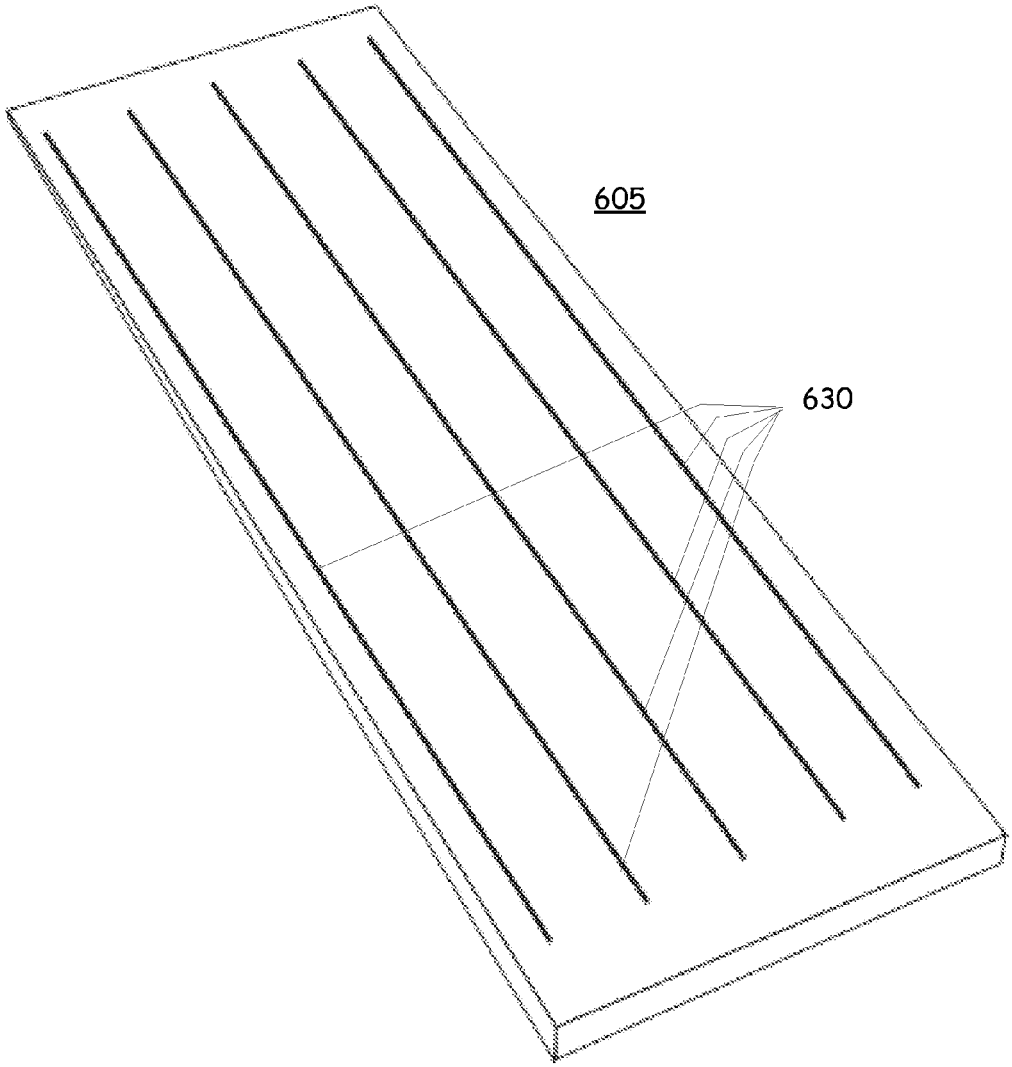
FIG. 6 is a perspective view of the back view of a shingle illustrating the ventilation ridges.

FIG. 6 is a perspective view of the back view of a shingle illustrating the ventilation ridges. The shingle 605 is shown as included multiple ridges 630 running along the length of the shingle 605 and spaced across the back face of the shingle 605. The ridges 630 can be formed using a variety of techniques and products and the present invention is not limited to any particular method, although the described methods may in and of themselves be considered as novel. In an exemplary embodiment, the ridges are created from beads of hot melt adhesive.

Figure 7:
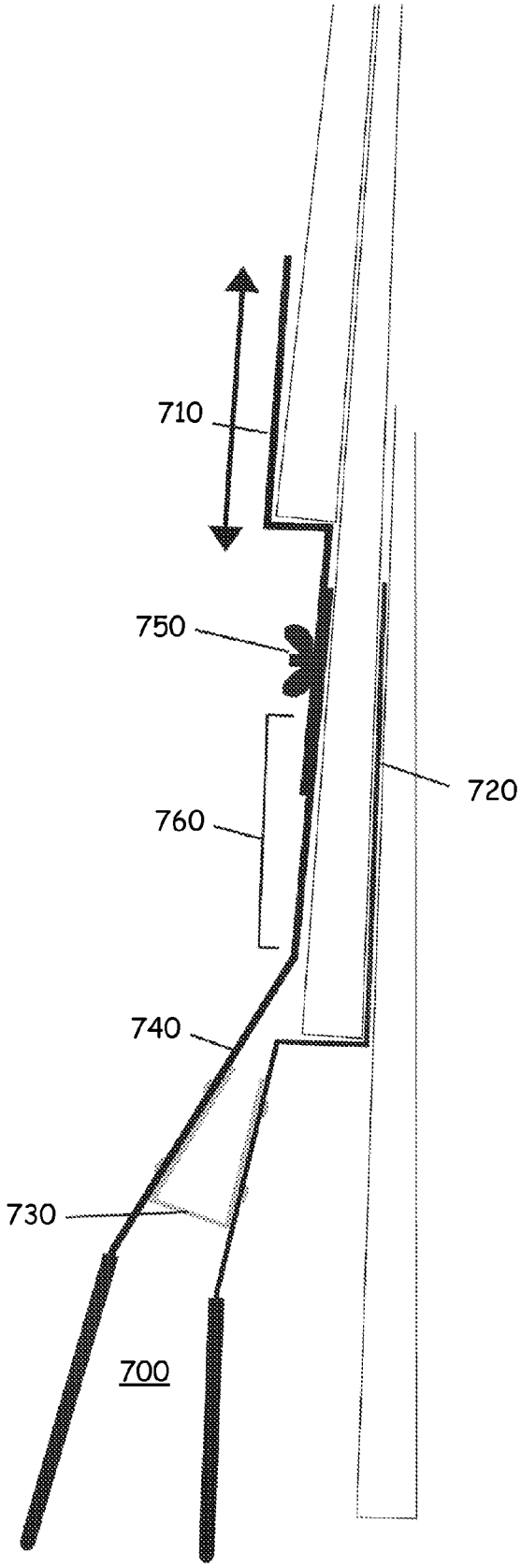
FIG. 7 shows a cross section of an installation tool in position on a shingle course illustrating an installation process for embodiments of the present invention.

FIG. 7 shows a cross section of an installation tool in position on a shingle course illustrating an installation process for embodiments of the present invention. A pair of installation tools are attached to an installed course of shingle strips to hold the shingle strips of the next course in position as they are attached. The tool 700 includes an adjustable height sliding bracket 710, base/spatula 720, spring clip 730, upper lever 740, a locking screw for the sliding bracket 750, and a printed or engraved exposure gauge 760 to indicate how much of the shingle will be exposed.

The tool can advantageously be used for installing the shingle panels constructed as described herein. The spatula base 720 is slid underneath a first course of shingles. The upper lever 740 which is attached to the spatula base 720 by a springing device such as the spring clip 730 then rests on the top side of the firsts course of shingles. The adjustable height sliding bracket 710 with the shelf on with a next course of shingles can rest, is then adjusted to the point on the exposure gauge 760 that defines the stacking offset desired. When two such tools are used, the next course can be rested on the shelf 755 while being fastened to the structure. The locking mechanism 750 secures the adjustable height sliding bracket to the upper structure.

Installation of the shingle strips/shingle set should be performed in accordance with all of the same guidelines and code requirements established for conventional cedar shingles. For instance, sheathing, building wrap, flashing, and details such as doubling the first course, hips, ridges, corners, etc., are all handled the same way as for conventional installation of individual shingles.

Figure 8:
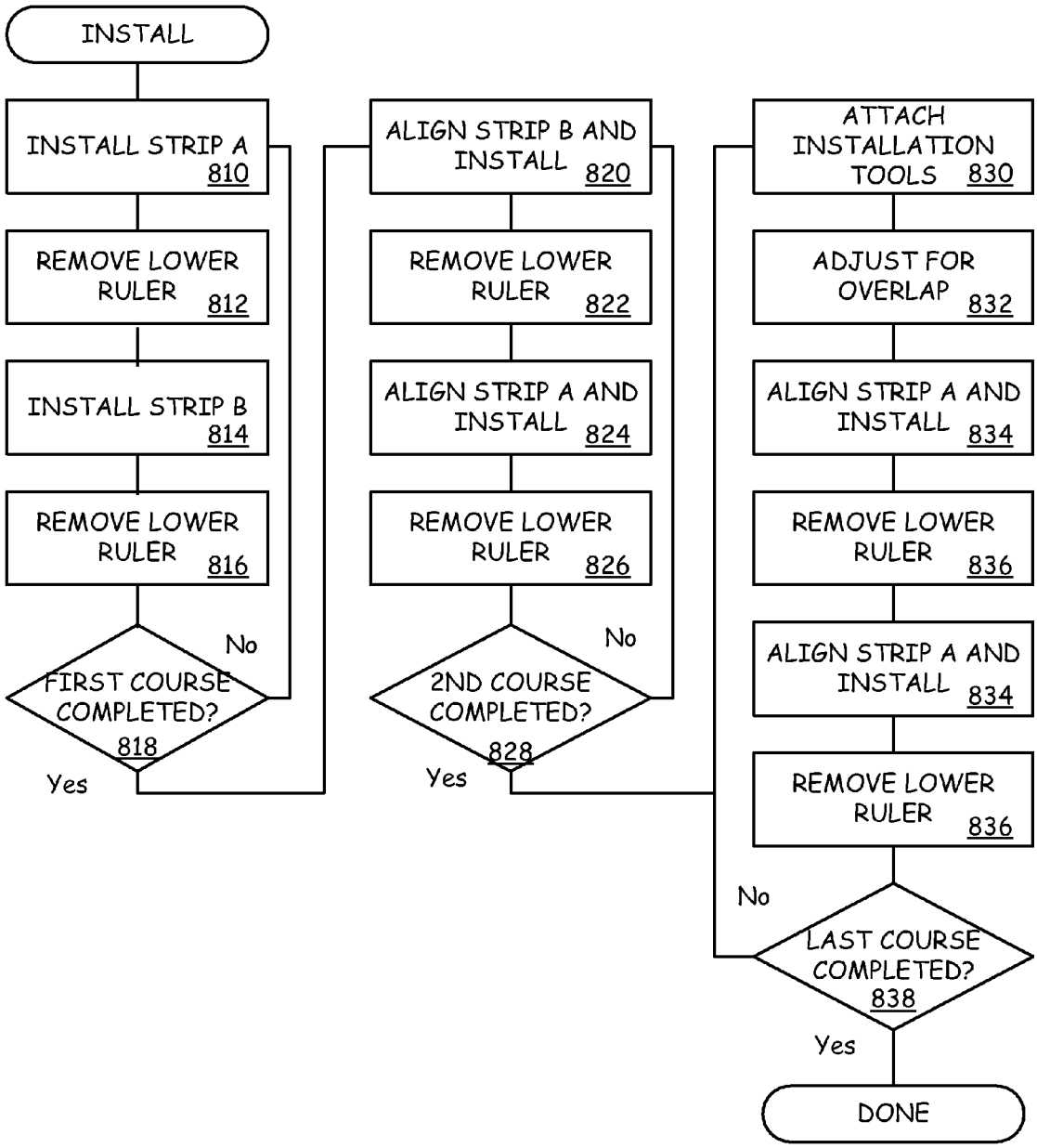
FIG. 8 is a flow diagram illustrating the steps involved in installing the shingle strips.

FIG. 8 is a flow diagram illustrating the steps involved in installing the shingle strips.

In general, the shingle strips are installed in one course at a time from left to right and bottom to top. Each individual shingle should be attached with 2 fasteners, using the same guidelines as for conventional shingles. Initially, the installation process begins by installing the first strip of the first course 810, typically the first strip is the A strip but, the process could also begin with the B strip. The first course is installed by laying alternating strips A and B side by side across the bottom surface to be covered. Once the first strip of the first course is installed, the lower bonding strip/ruler (4) is removed 812. The lower bonding strip/ruler (4) is removed by pulling the tab at the right end of the lower front bonding strip/ruler (4) on each strip to remove it from the face of the shingle strips along with the shingle spacers (1). The process then continues by installing the B strip 814 and then removing the lower bonding strip/ruler (4) of the B strip 816. This process repeats 818 until the first course is completed. In FIG. 5, the portion of the installation showing the first course would be strips 510, 512 and 514.

The numbers and markings on the printed upper ruler (3) can be used to check that strips are being alternated properly. If strips A and B are alternated properly, the numbers will be continuous and will cycle from 0 to 95 across the course.

The second course is installed on top of the first course and, according to standard practice, the second course fully overlaps the first course. Position the strips so the main numbers in the new course align vertically with the guide numbers of the previous course. Use the edge of the shingle strip as a guide. When one pair of numbers is aligned, all of the numbers in the course will be aligned. Thus, the second course is installed by aligning strip B 520 over strip A 510 at a point where the number in the lower bonding/ruler 4 of strip B aligns with the number on the upper bonding/ruler 3 820. The lower bonding/ruler 4 is removed 822. Next, strip A is aligned and installed 824 and the lower bonding/ruler 4 is removed 826. This process is repeated until the second course is completed 828. In the example illustrated in FIG. 5, the second course would include strips 522, 524 and 526.

For the next and subsequent courses, an installation tool such as the one illustrated in FIG. 7 may be utilized, or some other conventional method may be used to establish the amount of exposure of the shingles. A pair of installation tools are attached to an installed course of shingle strips to hold the shingle strips of the next course in position as they are attached 830. The tool is then set to a position necessary to obtain the desired overlap 832. Again, the strips are installed one at a time alternating between strip A and B and positioned in accordance with the ruler system. Thus, strip A is aligned and installed 834 by positioning the strip so the main numbers in the strip align vertically with the guide numbers of the previous course and the lower bonding/ruler 4 is removed 836. Note, the edge of the shingle strip can be used as a guide in adjusting the vertical alignments. Next, strip B is then aligned and installed 838 and the lower bonding/ruler 4 is removed 849. Again, this process is continued until the course is completed.

Thus, the steps 830-838 are continued for the installation process, one course at a time until completed. During the installation, it may be necessary to work across openings for doors and widows. This is accomplished by cutting strips as needed to continue matching numbers with the course below.

It should be appreciated that the present invention may also be applied in embodiments in which the height of the shingles may vary. For instance, typical shingle heights are 14, 16 and 18 inches. In one embodiment of the invention, the panel may use various heights in the same panel to create a staggered look. In yet other embodiments, the keyways between the shingles may be varied throughout the panel. Other embodiments may utilize multiple spacers between the shingles to help further stabilize the panel and ensure that the shingles are parallel to each other.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. An assembly of shingles that can be mounted to a surface, the assembly comprising:

a pre-assembled panel including a plurality of side-by-side shingles that are connected to each other with a bonding strip prior to being installed;

a removable spacer located between each side-by-side shingle pair for retaining the plurality of side-by-side shingles at a position with a keyway between each two adjacent shingles;

a first alignment gauge positioned on the front face of the panel;

a second alignment gauge positioned on the front face of the panel;

the shingles within the panel and the first and second alignment gauges being configured in such a manner that a second panel being placed on top of and overlapping a first panel and arranged such that when a first indicator on the first alignment gauge of the second panel is aligned relative with a second indicator on the second alignment gauge of the first panel, the keyways of the first panel do not align with any of the keyways of the second panel, wherein the shingles within the panel and the first and second alignment gauges being configured in such a manner that a third panel being placed on top of and overlapping the second panel and arranged such that when a third indicator on the first alignment gauge of the third panel is aligned relative to a fourth indicator on the second alignment gauge of the second panel, the keyways of the third panel do not align with any of the keyways in the second panel or the first panel, and wherein the first alignment gauge is a flexible strip of material that is removeably affixed to the face of the panel.

2. An assembly of shingles that can be mounted to a surface, the assembly comprising:

a pre-assembled panel including a plurality of side-by-side shingles that are connected to each other with a bonding strip prior to being installed;

a removable spacer located between each side-by-side shingle pair for retaining the plurality of side-by-side shingles at a position with a keyway between each two adjacent shingles;

a first alignment gauge positioned on the front face of the panel;

a second alignment gauge positioned on the front face of the panel;

the shingles within the panel and the first and second alignment gauges being configured in such a manner that a second panel being placed on top of and overlapping a first panel and arranged such that when a first indicator on the first alignment gauge of the second panel is aligned relative with a second indicator on the second alignment gauge of the first panel, the keyways of the first panel do not align with any of the keyways of the second panel, wherein the first alignment gauge is removeably affixed to the panel and each of the plurality of spacers in such a manner that when the first alignment gauge is removed, the spacers are removed from the panel.

3. The assembly of claim 2, wherein the panel is configured such that the panel can exist in two approximately equal sized strips.

4. An assembly of shingles that can be mounted to a surface, the assembly comprising:

a pre-assembled panel including a plurality of side-by-side shingles that are connected to each other with a bonding strip prior to being installed;

a removable spacer located between each side-by-side shingle pair for retaining the plurality of side-by-side shingles at a position with a keyway between each two adjacent shingles;

a first alignment gauge positioned on the front face of the panel;

a second alignment gauge positioned on the front face of the panel;

the shingles within the panel and the first and second alignment gauges being configured in such a manner that a second panel being placed on top of and overlapping a first panel and arranged such that when a first indicator on the first alignment gauge of the second panel is aligned relative with a second indicator on the second alignment gauge of the first panel, the keyways of the first panel do not align with any of the keyways of the second panel, wherein the spacers are of substantially equal width and ensure a consistent sized keyway between the shingles and, at least two or more of the shingles in the assembly have a different width.

5. An assembly of shingles that can be mounted to a surface, the assembly comprising:

a pre-assembled panel including a plurality of side-by-side shingles that are connected to each other with a bonding strip prior to being installed;

a removable spacer located between each side-by-side shingle pair for retaining the plurality of side-by-side shingles at a position with a keyway between each two adjacent shingles;

a first alignment gauge positioned on the front face of the panel;

a second alignment gauge positioned on the front face of the panel;

the shingles within the panel and the first and second alignment gauges being configured in a such a manner that a second panel being placed on top of and overlapping a first panel and arranged such that when a first indicator on the first alignment gauge of the second panel is aligned relative with a second indicator on the second alignment gauge of the first panel, the keyways of the first panel do not align with any of the keyways of the second panel, wherein the first alignment gauge is a flexible strip of material that is removeably affixed to the face of the panel and provides a semi-rigid structure to the panel.

6. A method for structuring a shingle assembly, the method comprising the steps of:

selecting a panel width;

arranging shingles of at least two or more different widths within the panel width with keyways between adjacent shingles in such a manner that two successive sets of the panels can overlap the shingle panel and the keyways of the three panels will not line up with each other by:

defining a vertical grid within the panel width;

arranging a first set of shingles of various widths on the grid by laying shingles adjacent to each other with spacing between them for substantially the defined width of the panel;

arranging a second set of shingles above the first set of shingles, the second set of shingles using the same width shingles, in the same order and with the same spacing as the first set of shingles but, shifted a first offset in a first direction;

moving the shingles of the second set of shingles on an end that extends beyond the panel width as a result of the shift onto the opposing end of the second set of shingles while maintaining the same order;

arranging a third set of shingles above the second set of shingles, the third set of shingles using the same width shingles, in the same order and with the same spacing as the first set of shingles but, shifted a second offset in the first direction;

moving the shingles of the third set of shingles on an end that extends beyond the panel width as a result of the shift onto the opposing end of the third set of shingles while maintaining the same order; and if any of the spaces between the shingles in the first set of shingles, the second set of shingles and the third set are in alignment, performing identical adjustments in each set to ensure that the spaces are not in alignment;

placing a removable spacer between adjacent shingles; and connecting each of the shingles to adjacent shingles with an adhesive to form a pre-assembled panel of multiple shingles that can be installed on a surface as a single assembly, adhering a plurality of ridges along backside of the shingles and along the length of the shingles;

adhering a first ruler at a first position traversing the front of the shingles across the panel width;

adhering a second ruler at a second position traversing the front of the shingles across the panel width;

wherein the relationship between the indicia on the first ruler and the second ruler is such that the first offset and the second offset can be identified.

7. The method of claim 6, further comprising the step of adhering at least one bonding strip on the back side of the shingles and traversing each of the spaces between the shingles.

8. The method of claim 6, wherein the first ruler is removeably adhered to the shingles and further comprising the step of also adhering the first ruler to the spacers.

9. The method of claim 6, wherein the first ruler is removeably adhered to the shingles and the spacers are integral with the first ruler.

10. A tool used for installing the shingles constructed by using the method of claim 8, wherein the tool comprises:

a spatula base that can be slid underneath a first course of shingles;

an upper lever that is attached to the spatula base by a springing mechanism and that rests on the top side of the first course of shingles;

an adjustable height sliding bracket with a shelf on which a next course of shingles can rest;

an exposure gauge on the face of the upper lever that indicates the position of the adjustable height sliding bracket; and a locking mechanism to secure the adjustable height sliding bracket to the upper structure.

* * * * *